US007738979B2

(12) United States Patent
Schmuck et al.

(10) Patent No.: US 7,738,979 B2
(45) Date of Patent: Jun. 15, 2010

(54) WORK TOOL NOTIFICATION AND USER-SELECTABLE MACHINE CONTROL CONFIGURATION

(75) Inventors: Benjamin B. Schmuck, Glen Ellyn, IL (US); Steven C. Budde, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 246 days.

(21) Appl. No.: 11/933,431

(22) Filed: Nov. 1, 2007

(65) Prior Publication Data

US 2009/0118844 A1 May 7, 2009

(51) Int. Cl.
*G05B 15/00* (2006.01)
*G06F 19/00* (2006.01)
*G06F 17/00* (2006.01)

(52) U.S. Cl. ..... 700/85; 700/188; 701/58

(58) Field of Classification Search ..... 700/85
See application file for complete search history.

(56) References Cited

U.S. PATENT DOCUMENTS 6,061,617 A 5/2000 Berger et al.
6,343,237 B1 1/2002 Rossow et al.
6,542,789 B2 4/2003 Ufheil
6,928,353 B2 8/2005 Finley et al.
6,962,475 B2 11/2005 Fatemi
7,010,367 B2 3/2006 Koch et al.
7,099,722 B2 * 8/2006 Casey ..... 700/85
2002/0087245 A1 7/2002 Rossow et al.
2005/0283295 A1 12/2005 Normann
2006/0112685 A1 6/2006 Devier et al.
2006/0129280 A1 6/2006 Thomas et al.
2006/0271263 A1 11/2006 Self et al.

* cited by examiner

*Primary Examiner*—Ramesh B Patel
*Assistant Examiner*—Sivalingam Sivanesan
(74) *Attorney, Agent, or Firm*—Leydig, Voit & Meyer

(57) ABSTRACT

A control system for controlling one or more actuators in a machine in response to installation of a tool to the machine detects the installation of a tool to the machine and prompts a user of the machine to configure the operation of the controller with respect to at least one of the one or more actuators.

18 Claims, 4 Drawing Sheets

WORK TOOL NOTIFICATION AND USER-SELECTABLE MACHINE CONTROL CONFIGURATION

TECHNICAL FIELD

The present disclosure relates generally to machine control reconfiguration, and more particularly, to a control system having a tool change triggered prompt mode to prompt the user for reconfiguration information.

BACKGROUND

Large industrial machines such as wheel loaders, excavators, bucket loaders, etc., can be expensive to acquire and operate, and it is thus desirable to utilize the machine in question for as many tasks as possible. However, a given machine configuration may not be suitable for all desired tasks. Thus, many such machines support interchangeable attachments or "tools," so that a wider variety of tasks may be accomplished using the same base machine. There are numerous attachments known in the art, including buckets, scoops, forks, booms, brushes, diggers, backhoes, jack hammers, etc. Many times, the machine's response to its user control interface must be changed when the tool is changed so that the new tool will operate properly. For example, the range, direction, and coordination of hydraulic actuators associated with the tool may differ significantly from tool to tool.

As a specific nonlimiting example, when a fork loader is attached to a machine, the movements of the associated hydraulic actuators are generally coordinated so that as the forks are raised and lowered, the forks remain essentially parallel to the ground. In contrast, a bucket may be required to tilt forward when raised. Typically, such associations between actuators need to be programmed for each tool so that the tool responds appropriately when the user operates the user controls.

Although it is possible for a user to manually reprogram the machine controller at the time that the tool is changed, this requires the user to have substantial familiarity with the tool and the machine to understand the manner in which the controller should be reconfigured. On the other hand, certain systems have evolved to avoid the user-interaction altogether by recognizing a new tool and automatically reconfiguring the controller accordingly. For example, U.S. Pat. No. 6,061,617 to Berger at al. entitled "Adaptable Controller For Work Vehicle Attachments" describes a system that employs data storage devices corresponding with the specific tools. Each data storage device contains instruction relating to a specific tool, and the machine controller operates the actuator in accordance to the data read from the data storage device. In another embodiment the machine controller reads identification data directly from the new tool and selects corresponding instruction data from a memory device. However, it is appreciated by the applicants that systems that entirely remove the element of user control are in some ways as deficient as systems that require complete user control.

The disclosed machine configuration system is directed to overcoming one or more of the deficiencies in known systems in certain embodiments, although it will be appreciated that the foregoing background discussion is intended solely to aid the reader. It is not intended to limit the disclosure or claims, and thus should not be taken to indicate that any particular element of a prior system is unsuitable for use, nor is it intended to indicate any element, including solving the motivating problem, to be essential in implementing the examples described herein or similar examples.

BRIEF SUMMARY

The disclosure describes, in one aspect, a machine control system for controlling one or more actuators in a machine in response to installation of a tool to the machine. In this embodiment, the control system comprises a controller for controlling the one or more actuators, an alert device for detecting the installation of a tool to the machine and for transmitting a detection signal to the controller in response to the detection, and a configuration routine on a computer-readable medium associated with the controller operable by the controller and comprising instructions to display a prompt to a user of the machine in response to receipt of the detection signal and instructions for receiving and processing user input to the controller by the user in order to configure the operation of the controller with respect to at least one of the one or more actuators.

The disclosure describes, in another aspect, a machine control system for controlling a tool in response to installation of a tool to the machine. In this embodiment, the control system comprises an alert device for detecting installation of a tool to the machine and for transmitting a detection signal in response to the detection, and a controller adapted to receive the detection signal and, in response to receipt of the detection signal, to prompt to a user of the machine to configure the controller to operate the tool and to receive user input to the controller by the user in order to configure the controller.

The disclosure describes, in yet another aspect, a computer-readable medium having thereon computer-readable instructions for the configuration of a machine controller. In this embodiment, the computer-readable instructions include instructions for detecting installation of a tool to the machine, instructions for prompting a user of the machine to configure the controller to operate the tool, instructions for receiving user input responsive to the prompt, and instructions for configuring the controller in keeping with the user input.

Other aspects, features, and embodiments of the described system and method will be apparent from the following discussion, taken in conjunction with the attached drawing Figures.

DETAILED DESCRIPTION

In general terms, this disclosure relates to a system and method of machine control reconfiguration, wherein a tool change triggers a prompt mode, whereby a user is prompted to provide reconfiguration information and/or selections. In particular, a machine controller is configured to properly control and coordinate one or more hydraulic actuators based on the nature of the tool attached to the machine. Exemplary embodiments and environments will be described below to aid the reader's understanding, but it will be appreciated that the appended claims, and not this description, define the metes and bounds of the innovation.

Figure 1:
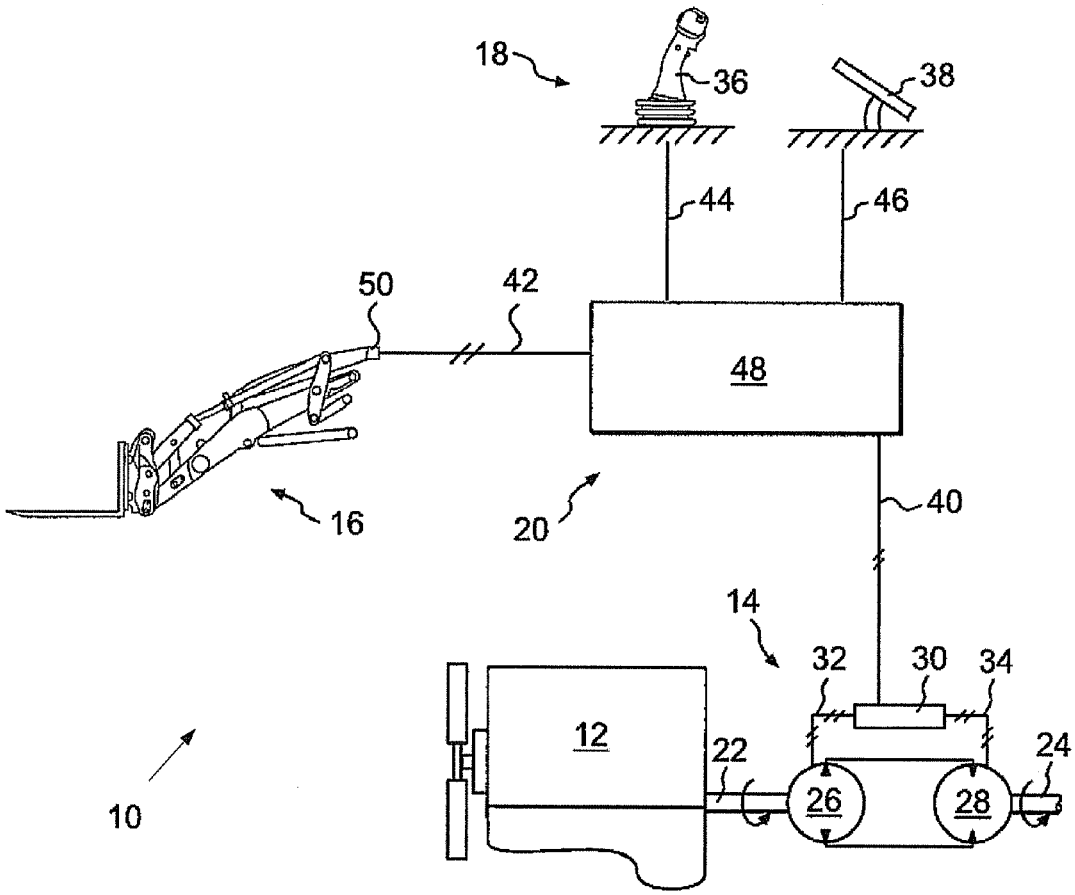
FIG. 1 is a schematic illustrations of the primary systems and interconnections of an exemplary machine usable in accordance with the principles described herein.

FIG. 1 illustrates at a schematic level the major systems and interconnections of an exemplary machine 10. Machine 10 may be a fixed or mobile machine that performs one or more industrial operations, such as operations associated with mining, construction, farming, and other industries known in the art. For example, machine 10 may be a material handler, a backhoe, an integrated tool carrier, a loader, or any other machine known in the art. Machine 10 may include a power source 12, a transmission 14, a work tool 16 removably attachable to machine 10, an operator interface 18, and a control system 20.

Power source 12 preferably includes an internal combustion engine such as, for example, a diesel engine, a gasoline engine, a natural gas engine, or any other engine apparent to one skilled in the art. However, power source 12 may additionally or alternatively include another source of power such as an electrical or other applicable source of power.

Transmission 14 is configured to transmit power from power source 12 to an output device (not shown), e.g., at a range of output speed ratios. Transmission 14 may be a hydraulic transmission, mechanical transmission, hydro-mechanical transmission, electric transmission, or other suitable transmission. The output device includes a ground engaging mechanism, e.g., wheels, tracks, belts, or other ground engaging device known in the art. An input drive member such as, for example, a countershaft 22, connects power source 12 to transmission 14. Transmission 14 also includes an output driven member, e.g., an output shaft 24 connecting transmission 14 to the output device. In this manner, power generated by power source 12 is transmitted through output shaft 24 to the output device. Although it is noted above that the transmission 14 supports a range of discrete or continuously variable output speed ratios, it is contemplated that transmission 14 could alternatively transmit power from power source 12 to the output device at a single output speed ratio.

In one embodiment, transmission 14 may be a hydraulic transmission having a pump 26 and a motor 28. Pump 26 and motor 28 may be variable displacement, variable delivery, fixed displacement, or any other configuration known in the art. Pump 26 may be directly connected to power source 12 via countershaft 22. Alternately, pump 26 may be connected to power source 12 via a torque converter, a gear box, or in any other manner known in the art. In the illustrated example, motor 28 is fluidly connected to the pump 26 by conduits that supply and return fluid to and from the pump 26 and motor 28, allowing pump 26 to effectively drive motor 28 by fluid pressure. Motor 28 may be directly connected to the output device via output shaft 24. Machine 10 may or may not include a reduction gear arrangement such as, for example, a planetary arrangement disposed between motor 28 and the output device.

Transmission controller 30 may be in communication with pump 26 and motor 28 via control lines 32 and 34, respectively, and configured to change displacements of pump 26 and/or motor 28 in response to a desired travel speed of machine 10 to thereby control the output rotation of output shaft 24. Control lines 32 and 34 may be digital, analog, or hybrid communication lines. Alternately, communication between with the various components of transmission 14 may be implemented by means of mechanical or hydraulic lines.

Various tools or implements are attachable to a single machine and controllable via operator interface 18. The terms "tool" and "implement" are used interchangeably herein to refer to an apparatus that is removably attachable to a machine, e.g., machine 10, to perform a task or activity. For example, tool 16 may include a fork arrangement, a blade, a bucket, a shovel, a ripper, a dump bed, a broom, a snow blower, a propelling device, a cutting device, a grasping device, or any other task-performing device known in the art. Tool 16 may be connected to machine 10 via a direct pivot, a linkage system, one or more hydraulic cylinders, or any other appropriate means. Tool 16 may be configured to pivot, rotate, slide, swing, lift, or move relative to machine 10 as known in the art.

Operator interface 18 may be located within an operator cabin of machine 10, in close proximity to a seat (not shown), and may include numerous mechanisms to control the components, features, and functions of machine 10. In one example, operator interface 18 includes a joystick controller 36 and a foot pedal 38. Moreover, operator interface 18 may include additional or different control devices such as, for example, levers, switches, buttons, pedals, wheels, and other control mechanisms known in the art.

Generally, joystick controller 36 is configurable to control a movement of the tool 16, and in particular to control a direction and/or speed of movement of the tool or some portion thereof. For example, joystick controller 36 may be tiltable in a forward position relative to a machine operator to cause movement of work tool 16 in a first direction. The joystick controller 36 is typically, although not necessarily, tiltable in a rearward position relative to the machine operator to cause movement of work tool 16 in a second direction opposite to the first direction. Similarly, the joystick controller 36 typically has a maximum and a minimum tilt angle limit in both the forward and rearward directions and can be tilted to any angle between the maximum and minimum positions in order to move the tool 16 or some portion thereof at a corresponding speed between a maximum and minimum travel speed in the associated direction. The ratio of the percent of maximum travel speed to the percent of maximum tilt angle of joystick controller 36 may be considered a tool movement speed gain.

It is contemplated that joystick controller 36 may be tiltable about multiple axis, twistable, and/or movable in any other manner. It is further contemplated that joystick controller 36 may be configured to control additional machine functions other than movement of tool 16. It is also contemplated that the movement of tool 16 may be controlled by a control device other than joystick controller 36 such as, for example, a slide mechanism, a wheel mechanism, a pedal, or any other appropriate device.

Foot pedal 38 may be configured to control a travel speed and/or rimpull torque of machine 10. The rimpull is a measure of the torque at the output device (e.g., wheels, tracks, belts, or other ground engaging device known in the art). The travel speed and/or rimpull torque of machine 10 may be proportional to an actuation position of foot pedal 38. For example, foot pedal 38 may be pivotable in a first direction to indicate an increase in a desired travel speed and/or rimpull torque of machine 10. Foot pedal 38 may also be pivotable in a second direction opposite the first direction to indicate a decrease in the desired travel speed and/or rimpull torque of machine 10. In an embodiment, foot pedal 38 has a maximum pivot limit in the first direction and a minimum pivot limit in the second direction and may be pivotal to any position between the maximum and minimum positions to set a desired travel speed and/or rimpull torque of machine 10 at a corresponding speed between a maximum and minimum travel speed and/or rimpull torque. The ratio of a percent of maximum travel speed to a percent of maximum pivot angle of foot pedal 38 may be considered a machine travel speed gain. The ratio of a percent of maximum rimpull torque to a percent of maximum pivot angle of foot pedal 38 may be considered a machine rimpull torque gain. The travel speed and/or rimpull torque of machine 10 may be controlled by a control device other than foot pedal 38, e.g., a slide mechanism, a wheel mechanism, a joystick, or any other appropriate device.

Control system 20 is in communication with transmission controller 30 of transmission 14 via a communication line 40, with work tool 16 via a communication line 42, with joystick controller 36 via a communication line 44, and with foot pedal 38 via a communication line 46. Control lines 40, 46 may be digital, analog, or hybrid communication lines. In the illustrated embodiment, control system 20 includes a control module 48, a tool installation alert device 50.

Control module 48 typically includes a microprocessor that includes a means for storing and comparing information, and for controlling the operation of power source 12. Control module 48 may be embodied in a single microprocessor or multiple microprocessors, as well as related peripheral circuitry such as external memory, etc. Numerous commercially available microprocessors can be configured to perform the functions of control module 48. It will be appreciated that control module 48 could readily be embodied in a general machine microprocessor capable of controlling numerous machine functions. Control module 48 may include any means for storing, comparing, and controlling such as a memory, one or more data storage devices, or any other components that may be used to run an application. Furthermore, although certain data described in the present disclosure may be generally described as being stored in memory, one of skill in the art will appreciate that this data can be stored on or read from any type of computer-readable medium, e.g., memory chips and secondary storage devices, including hard disks, floppy disks, optical media, CD-ROM, or other forms of RAM or ROM. Various other known circuits may be associated with control module 48, including power supply circuitry, signal-conditioning circuitry, solenoid driver circuitry, communication circuitry, and other appropriate circuitry.

Control module 48 is configurable to change the operation of the machine 10. In particular, the control module 48 can be configured to alter tool movement speed gain, machine travel speed gain, and/or machine rimpull gain. For example, control module 48 may implement a first tool movement speed gain, machine travel speed gain, and/or machine rimpull gain when a first tool 16 is attached to machine 10, and a second tool movement speed gain, machine travel speed gain, and/or machine rimpull gain when a second tool 16 is attached to machine 10. Of course, third and subsequent tool movement speed gains, machine travel speed gains, and machine rimpull gains can be implemented as well, e.g., when no tool 16 is attached to machine 10 or when a different tool than the first and second tolls is attached to the machine 10.

The tool installation alert device 50 is configured to automatically generate a signal indicative of a tool 16 being attached to machine 10 and to direct that signal to control module 48. Specifically, tool installation alert device 50 is in communication via communication line 42 with control module 48. The signal indicative of a tool 16 being attached to machine 10 may, but need not, contain other information specifically related to the attached tool.

Tool installation alert device 50 includes a sensing device such as, for example, an optical sensor, laser sensor, magnetic sensor, key, button, pin, switch, or other appropriate sensor configured to detect the renewed presence or installation of the tool 16. Because a tool may remain installed on a machine for a period of time, it is not necessarily desirable to prompt the user every time he or she starts the machine. Rather, it is preferable to prompt the user only when the tool is installed.

Figure 2:
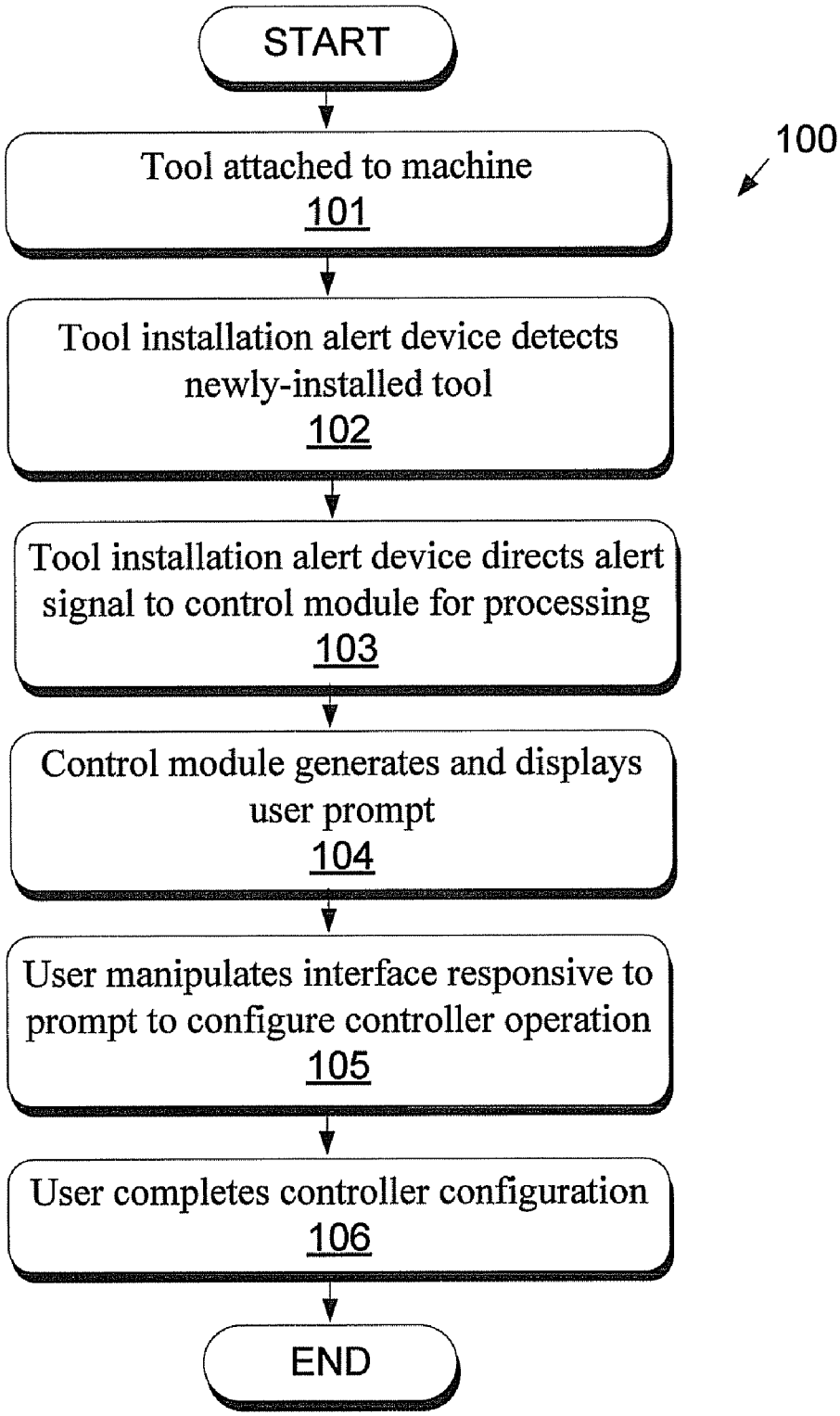
FIG. 2 is a flow chart illustrating an exemplary process of machine controller configuration in accordance with the present disclosure.

Turning to FIG. 2, flow chart 100 illustrates an exemplary process of machine configuration in accordance with the present disclosure. It will be appreciated that the order of steps in every implementation need not be the same as that disclosed, nor will every implementation include each and every step. Moreover, implementations may include additional steps beyond those shown according to specific designer preferences or design goals. The process illustrated via the flow chart 100 in FIG. 2 will be described with additional reference to FIGS. 3 and 4 as appropriate.

In stage 101 of process 100, a tool 16 is attached to the machine 10. If another tool was previously attached to the machine 10, it is removed prior to stage 101. As the tool 16 is attached to the machine 10, the tool installation alert device 50 detects the tool 16 in stage 102 and generates an alert signal indicative of the tool 16 being attached. In stage 103, the tool installation alert device 50 directs the alert signal over line 52 to the control module 48 for processing.

The control module 48 generates and displays a user prompt in stage 104, whereby the user is alerted to the attachment of the tool and the need to reconfigure the controller within control module 48 (or to confirm the present configuration) to account for the new attachment. The user prompt may be graphical, e.g., via a graphical user interface, or may be more basic, e.g., a flashing LED. In the illustrative embodiment of a graphical user interface discussed herein, the user prompt may require the user to input specific configuration information at one or more of a number of levels of specificity.

Figure 3:
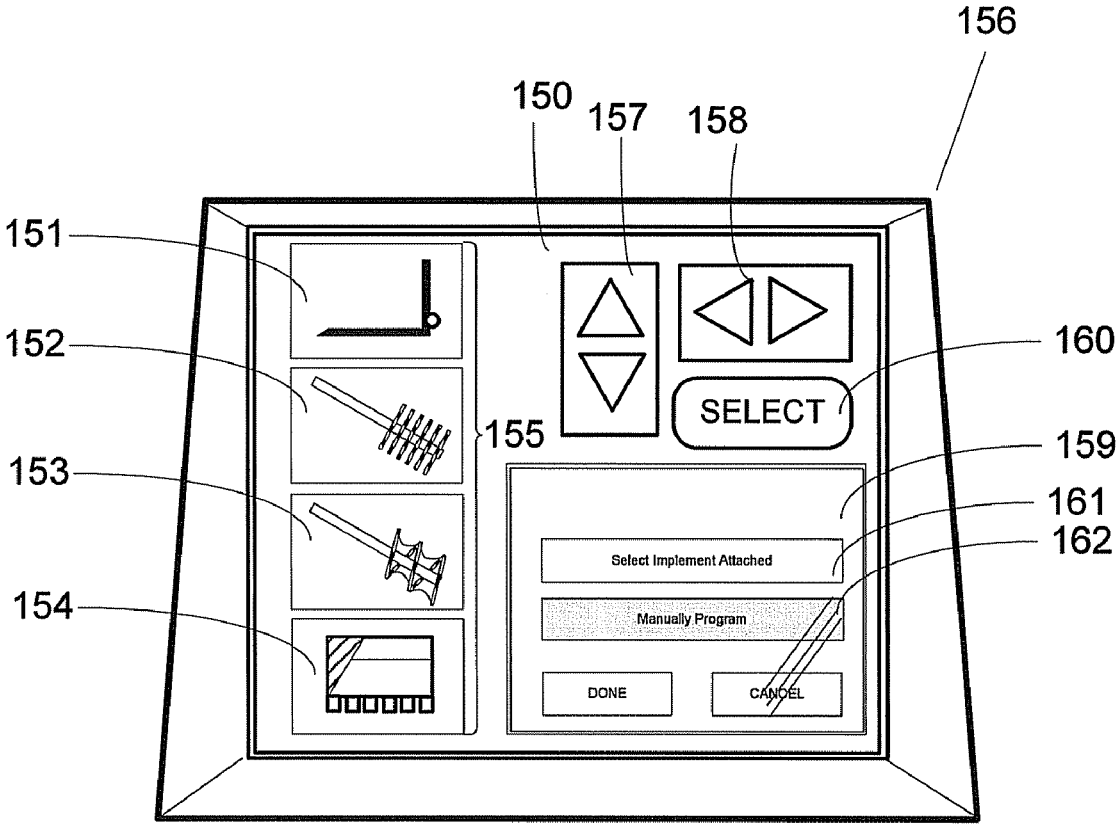
FIG. 3 is an exemplary user interface according to an embodiment of the disclosure.

For example, the user interface 150 in the simplified illustrated embodiment of FIG. 3 prompts the user to selected a tool from among tool options 151, 152, 152, 154 displayed pictorially in an on-screen menu 155 of the machine 10 display system 156. The user interface 150 comprises additional interface elements in the illustrated embodiment. For example, the interface 150 also comprises scroll buttons 157, 158, and a textual readout area 159. If used for user input, the textual readout area 159 may be touch sensitive, or the scroll buttons 157, 158 may be used to select an element of the readout area 159 for selection via the select button 160.

The textual read-out area may be used to display any desired text or graphics, but in an embodiment, the area 159 presents selectable configuration options. For example, in the illustrated embodiment, the area 159 includes two selectable configuration option keys 161, 162 for selecting a graphical configuration mode, as illustrated, or a manual configuration mode, respectively. Although the graphical configuration mode is illustrated in FIG. 3, it will be appreciated that the default mode upon attachment of a tool 16 may be set to either mode, or another mode entirely, depending upon designer preferences.

Figure 4:
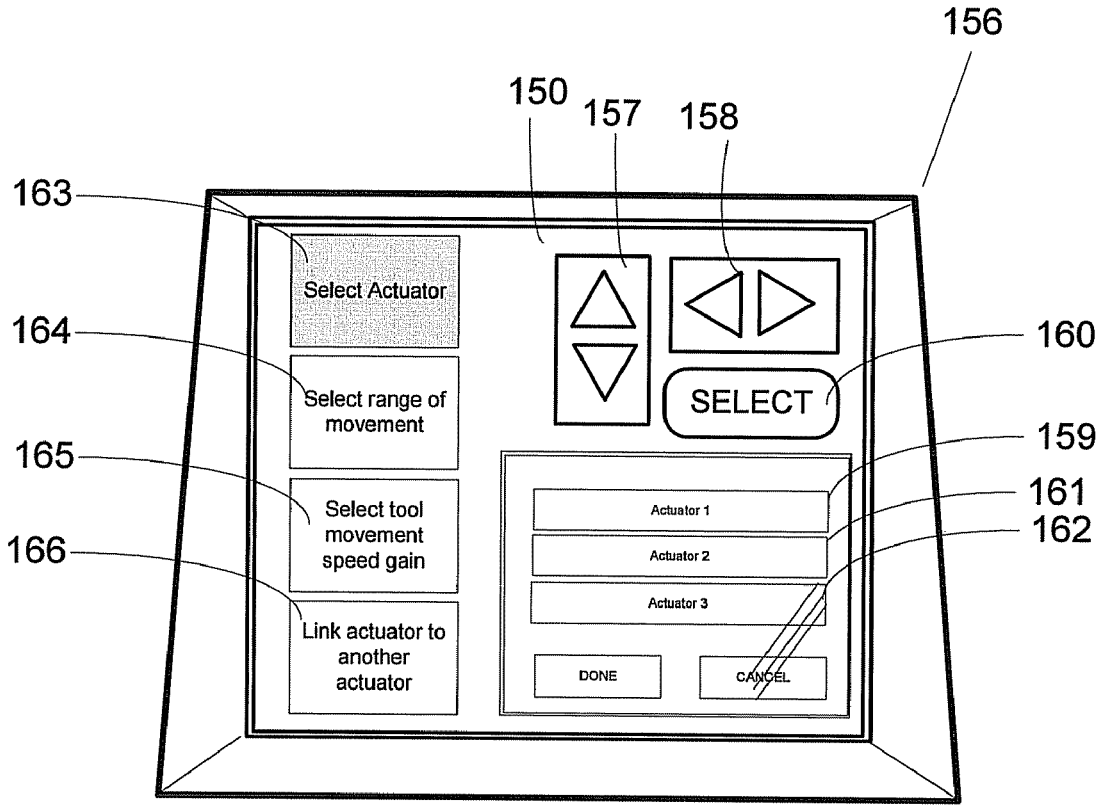
FIG. 4 is an exemplary user interface according to another embodiment of the disclosure.

The schematic diagram of FIG. 4 illustrates a user interface corresponding to a manual configuration mode according to one embodiment. In this mode, the user is able to configure the response of the system actuators to the user control elements such as the joystick 36 and pedal 38. In the illustrated view, the "Select Actuator" option 163 is selected and the readout area 159 displays a selectable list of actuators. Other displayed configuration actions include "Select Range Of Movement" 164, "Select Tool Movement Speed Gain" 165, and "Link Actuator To Another Actuator" 166.

The various actuators of the list of actuators shown in readout area 159 may be selected to access further configuration options in an embodiment. For example, if an actuator has been selected and the user then selects the "Select Range of Movement" option 164, a user interface preferably appears in one embodiment to allow the user to set the range of movement for the selected actuator.

At stage 105 of process 100, the user optionally completes the configuration of the controller by selecting an appropriate key, such as the "Done" key, whereupon the process 100 ends and the controller exits the configuration routine.

INDUSTRIAL APPLICABILITY

The industrial applicability of the machine controller reconfiguration system described herein will be readily appreciated from the foregoing discussion. A technique is described wherein a machine controller detects the installation of a tool to the machine via an alert device and in response prompts the machine user to configure the operation of the controller to operate with the installed tool. The user is provided information and options to select predetermined configurations in an embodiment, but may also manually configure the controller in a different manner.

The disclosed machine controller reconfiguration system is applicable to any hydraulically actuated machine that includes one or more hydraulic actuators where the machine supports different tools, that require or benefit from different respective operations of the actuators, in terms of range and direction of motion as well as coordination of actuators.

Upon installation of a tool on the machine, an alert device detects the presence of the tool and prompts the user to configure the controller for appropriate operation with the new tool. For example, the range and direction of motion of the associated actuators in response to user control inputs may need to be modified. Moreover, certain tools may require coordination of specific actuators in response to a single control input. The user is presented with a configuration interface in an embodiment so that the user may easily select configuration actions and values.

It will be appreciated that the foregoing description provides examples of the disclosed system and technique. However, it is contemplated that other implementations may differ in detail from the foregoing examples. All references to specific examples herein are intended to reference the particular example being discussed at that point and are not intended to imply any limitation as to the scope of the claims or disclosure more generally. All language of distinction and disparagement with respect to certain features of the described system or the art is intended to indicate a lack of preference for those features, but not to exclude such from the scope of the claims entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, the attached claims encompass all modifications and equivalents as permitted by applicable law. Moreover, any combination of the above-described elements in all possible variations thereof is encompassed unless otherwise indicated herein or otherwise clearly contradicted by context.

We claim:

1. A machine control system for controlling one or more actuators in a machine in response to installation of a tool to the machine, the control system comprising:

a controller for controlling the one or more actuators;

an alert device for detecting the installation of a tool to the machine and for transmitting a detection signal to the controller in response to the detection; and a configuration routine on a computer-readable medium associated with the controller operable by the controller and comprising instructions to display a prompt to a user of the machine in response to receipt of the detection signal and instructions for receiving and processing user input to the controller by the user in order to configure the operation of the controller with respect to at least one of the one or more actuators, wherein the instructions to display a prompt to the user of the machine in response to receipt of the detection signal further comprise instructions to present a selectable list of actuators to the user via a display device associated with the controller.

2. The machine control system according to claim 1, wherein the one or more actuators comprise one or more hydraulic actuators.

3. The machine control system according to claim 1, wherein the tool is selected from the group consisting of buckets, scoops, forks, booms, brushes, diggers, backhoes, and jack hammers.

4. The machine control system according to claim 1, wherein the alert device is selected from the group consisting of an optical sensor, a laser sensor, a magnetic sensor, a key, a button, a switch, and a pin.

5. The machine control system according to claim 1, wherein the instructions to display a prompt to the user of the machine in response to receipt of the detection signal further comprise instructions to present a selectable list of tools to the user via a display device associated with the controller.

6. The machine control system according to claim 5, wherein the selectable list of tools comprises one of a pictorial representation of a plurality of tools and a textual representation of a plurality of tools.

7. A control system for controlling a tool in response to installation of a tool to the machine, the control system comprising:

an alert device for detecting installation of a tool to the machine and for transmitting a detection signal in response to the detection; and a controller adapted to receive the detection signal and, in response to receipt of the detection signal, to prompt to a user of the machine to configure the controller to operate the tool and to receive user input to the controller by the user in order to configure the controller, wherein the controller is adapted to prompt the user by presenting a selectable list of actuators to the user via a display device associated with the controller.

8. The control system according to claim 7, wherein the controller causes a graphical prompt to be displayed to the user via a display device associated with the controller.

9. The control system according to claim 8, wherein the graphical prompt comprises a selectable list of tools.

10. The control system according to claim 9, wherein the selectable list of tools comprises one of a pictorial representation of a plurality of tools and a textual representation of a plurality of tools.

11. The control system according to claim 7, the controller is adapted to operate the tool via one or more actuators that are represented in the selectable list of actuators.

12. The control system according to claim 11, wherein the one or more actuators comprise one or more hydraulic actuators.

13. The control system according to claim 7, wherein the tool is selected from the group consisting of buckets, scoops, forks, booms, brushes, diggers, backhoes, and jack hammers.

14. The control system according to claim 7, wherein the alert device is selected from the group consisting of an optical sensor, a laser sensor, a magnetic sensor, a key, a button, a switch, and a pin.

15. A computer-readable medium having thereon computer-readable instructions for the configuration of a machine controller for controlling a machine, the computer-readable instructions comprising:

instructions for detecting installation of a tool to the machine;

instructions for prompting a user of the machine to configure the controller to operate the tool by presenting a selectable list of actuators to the user via a display device associated with the controller;

instructions for receiving user input responsive to the prompt; and instructions for configuring the controller in keeping with the user input.

16. The computer-readable medium according to claim 15, wherein the instructions for prompting the user comprise instructions for displaying a graphical prompt via a display device associated with the controller.

17. The computer-readable medium according to claim 16, wherein the graphical prompt is one of a textual list of tools and a pictorial list of tools.

18. The computer-readable medium according to claim 15, wherein the controller is adapted to operate the tool via one or more hydraulic actuators that are represented in the selectable list of actuators.

* * * * *